US010149516B2

(12) United States Patent
Fukuzawa et al.

(10) Patent No.: US 10,149,516 B2
(45) Date of Patent: Dec. 11, 2018

(54) HOOK-AND-LOOP FASTENER MANUFACTURING METHOD

(71) Applicant: YKK Corporation, Tokyo (JP)

(72) Inventors: Tetsuya Fukuzawa, Toyama (JP); Yasuaki Funo, Toyama (JP); Yoshitomo Iyoda, Tokyo (JP); Wanli Zhang, Toyama (JP)

(73) Assignee: YKK Corporation (JP)

( * ) Notice: Subject to any disclaimer, the term of this patent is extended or adjusted under 35 U.S.C. 154(b) by 6 days.

(21) Appl. No.: 14/926,317

(22) Filed: Oct. 29, 2015

(65) Prior Publication Data

US 2016/0128435 A1 May 12, 2016

(30) Foreign Application Priority Data

Nov. 7, 2014 (JP) ..... 2014-227050

(51) Int. Cl.
*A44B 18/00* (2006.01)

(52) U.S. Cl.
CPC ..... *A44B 18/0049* (2013.01); *A44B 18/0065* (2013.01)

(58) Field of Classification Search
CPC ..... B29C 45/0053; B29C 45/0055; B29C 2045/0058; B29C 45/0081; A44B 18/0049; A44B 18/0065; A44B 18/0053; A44B 18/0061
USPC ..... 24/442, 444, 448, 450
See application file for complete search history.

(56) References Cited

U.S. PATENT DOCUMENTS 4,429,441 A * 2/1984 Nishiyama ..... A44B 18/0026 24/442
4,760,625 A * 8/1988 Murasaki ..... A44B 18/0026 139/291 C
4,775,310 A * 10/1988 Fischer ..... A44B 18/0049 425/308

(Continued)

FOREIGN PATENT DOCUMENTS

JP H03-251204 A 11/1991
JP H06-090805 A 4/1994

(Continued)

OTHER PUBLICATIONS

Office Action, Japanese Patent Application No. 2014-227050, dated Jul. 24, 2018.

*Primary Examiner* — Matthew J Daniels
*Assistant Examiner* — Andrew D Graham
(74) *Attorney, Agent, or Firm* — Kilpatrick Townsend & Stockton LLP

(57) ABSTRACT

There is provided a hook-and-loop fastener manufacturing method. Injection molding is performed to form a molded product in which a pillar group and a base plate having a surface from which the pillar group protrudes are integrated into a unified body. A tip part of the pillar group is cut to form a cut product in which a small pillar group shorter than the pillar group and the base plate are integrated into a unified body. A tip part of the small pillar group is melted to form pillar body portions which are non-melted portions and engaging portions which are melted portions and thicker than the pillar body portions from small pillars. The engaging portions are cooled to determine shapes of a plurality of engaging elements including the pillar body portions and the engaging portions.

3 Claims, 8 Drawing Sheets

(56) References Cited

U.S. PATENT DOCUMENTS 5,785,784 A * 7/1998 Chesley ..... A44B 18/0049 156/231
6,039,911 A 3/2000 Miller et al.
6,592,800 B1 * 7/2003 Levitt ..... A44B 18/0049 264/167
6,678,924 B2 1/2004 Murasaki et al.
7,108,814 B2 * 9/2006 Herrero ..... A44B 18/0049 24/442
8,291,554 B2 * 10/2012 Duer ..... B01D 29/093 24/16 PB
9,649,824 B2 * 5/2017 Chandrasekaran ..... B32B 3/263
2006/0096072 A1 * 5/2006 Minato ..... A44B 18/0061 24/452
2009/0013506 A1 * 1/2009 Mizuhara ..... A44B 18/0069 24/442
2010/0180407 A1 * 7/2010 Rocha ..... B29C 59/04 24/452
2011/0258819 A1 * 10/2011 Cheng ..... A44B 18/0061 24/442
2012/0151720 A1 * 6/2012 Hanschen ..... A44B 18/0065 24/444
2013/0067701 A1 * 3/2013 Grady ..... A44B 18/0049 24/442
2013/0149490 A1 * 6/2013 Cina ..... B32B 3/30 428/100
2013/0167332 A1 * 7/2013 Terada ..... A44B 18/0065 24/450
2013/0280474 A1 * 10/2013 Medina ..... B32B 3/06 428/99
2015/0230564 A1 * 8/2015 Fujisawa ..... A44B 18/0076 24/444

FOREIGN PATENT DOCUMENTS

JP H07-509668 A 10/1995
JP 2001-507643 T 6/2001
WO 93/22120 A1 11/1993

* cited by examiner

HOOK-AND-LOOP FASTENER MANUFACTURING METHOD

CROSS-REFERENCE TO RELATED APPLICATION

The present application claims priority of Japanese Patent Application No. 2014-227050, filed on Nov. 7, 2014 and entitled "Hook-and-Loop Fastener Manufacturing Method and Hook-and-Loop Fastener", the entire contents of which are hereby incorporated by reference.

TECHNICAL FIELD

The present invention relates to a method of manufacturing a hook-and-loop fastener which is integrally molded by injection molding and a hook-and-loop fastener.

BACKGROUND

As an example of a hook-and-loop fastener, there is a hook-and-loop fastener in which a base plate and plural engaging elements protruding from one surface of the base plate are integrally molded. There are various types of engaging elements and an example thereof is an engaging element called mushroom in that the engaging element has the similar shape as a mushroom.

As an example of a method of manufacturing the hook-and-loop fastener according to the related art including mushroom engaging elements, there is a method using a base mold for molding a base plate, a head mold for molding heads of mushrooms, and a destructively-detachable leg mold for molding pillar-shaped legs of mushrooms (Patent Document 1). In this manufacturing method, after injection molding is carried out using the molds, the destructively-detachable legs are melted with, for example, water to move the base mold and the head mold in a direction in which both are separated from each other to enable mold opening.

Patent Document 1: Japanese Patent Application Publication No. H07-509668 A

However, in the above-mentioned manufacturing method, a material other than a resin which is a molding material is essentially required for the destructively-detachable leg mold. In addition, it is necessary to consider how to dispose of the destructively-detachable legs melted with water after the molding.

SUMMARY

It is therefore an object of the present invention to provide a hook-and-loop fastener manufacturing method and a hook-and-loop fastener in which a material other than a molding material does not have to be used as much as possible.

A hook-and-loop fastener manufacturing method according to an aspect of the embodiments of the present invention includes (1) an injection molding step, (2) a cutting step, (3) a melting step, and (4) a cooling step.

(1) The injection molding step is a step of performing injection molding to form a molded product in which a pillar group which is a set of plural pillars and a base plate having a surface from which the pillar group protrudes are integrated into a unified body.

(2) The cutting step is a step of cutting a tip part of the pillar group to form a cut product in which a small pillar group which is shorter than the pillar group and the base plate are integrated into a unified body.

(3) The melting step is a step of melting a tip part of the small pillar group to form pillar body portions which are non-melted portions and engaging portions which are melted portions and which are thicker than the pillar body portions from small pillars constituting the small pillar group.

(4) The cooling step is a step of cooling the engaging portions to determine shapes of a plurality of engaging elements including the pillar body portions and the engaging portions, thereby forming a hook-and-loop fastener in which an engaging element group which is a set of the engaging elements and the base plate are integrated into a unified body.

In the melting step, it does not matter whether a heater as a heat source for melting the tip part of the small pillar group comes in contact with the small pillar group. When the heater comes in contact with the small pillar group, molten resin may be attached to the heater and may serve as a cause of defective products. Therefore, it is preferable that the melting step be as follows.

That is, the melting step includes arranging a heater with respect to the tip part of the small pillar group in a non-contact state.

It is preferable that an engaging portion of each engaging element of the hook-and-loop fastener manufactured according to this embodiment be as follows.

That is, each of the engaging portions includes an engaging face protruding outward from a tip of the respective pillar body portions over the whole circumference in a circumferential direction thereof.

An intersection angle between the engaging face and a side surface of the pillar body portion does not matter particularly, but is preferably as follows.

That is, an intersection angle between the engaging face and a side surface of the respective pillar body portions is equal to or greater than 90° and less than 150°.

A hook-and-loop fastener according to another aspect of the embodiments of the present invention includes a base plate and an engaging element group which are integrally molded by injection molding. The engaging element group includes plural engaging elements protruding from plural positions on one surface of the base plate in a thickness direction thereof. Each of the engaging elements has a laminated structure comprised of resin layers extending from the inside of the base plate, and includes a pillar body portion protruding from the one surface of the base plate in the thickness direction thereof and a semispherical engaging portion having an engaging face protruding from an outer circumference of a tip of the pillar body portion over the whole circumference. In the pillar body portion, the resin layers are formed in parallel along a length direction of the pillar body portion and in the engaging portion, the resin layers are formed radially from the tip of the pillar body portion.

In the hook-and-loop fastener manufacturing method according to the aspect of the embodiments of the present invention, a material other than a resin as the molding material does not have to be used essentially. Since the cut tip part of the pillar group can be collected and reused, it is possible to easily dispose of undesired substance which is generated in the manufacturing course.

By setting the heater not to come in contact with the small pillar group in the melting step, it is possible to reduce the cause of defective products.

The hook-and-loop fastener according to another aspect of the embodiments of the present invention has a configuration in which each engaging element is formed by laminating resin layers extending from the inside of the base plate and is manufactured by the hook-and-loop fastener manufacturing method according to the aspect of the embodiments of the present invention.

BRIEF DESCRIPTION OF THE DRAWINGS

In the accompanying drawings:

FIG. 5A illustrates a cross-section of a molded product and FIG. 5B illustrates a cross-section of an example of a hook-and-loop fastener;

DETAILED DESCRIPTION

Figure 1A:
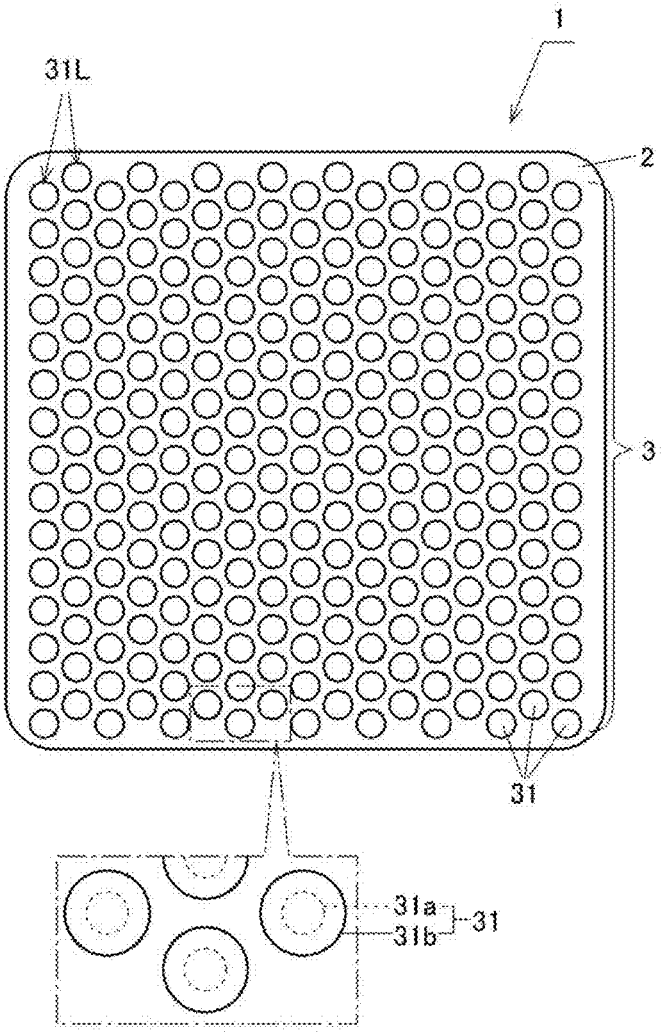
FIGS. 1A and 1B are a plan view and a front view illustrating an example of a hook-and-loop fastener which is manufactured according to the present invention, respectively.
Figure 1B:
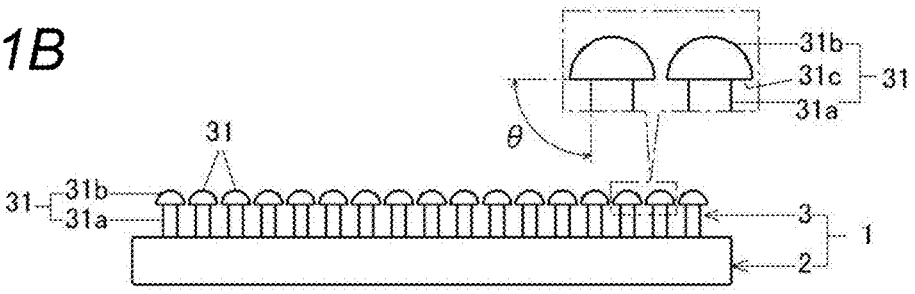

An example of a hook-and-loop fastener 1 which is manufactured according to the present invention is a mushroom hook-and-loop fastener as illustrated in FIGS. 1A and 1B. An example of the mushroom hook-and-loop fastener 1 according to the present invention includes a base plate 2 and an engaging element group 3 which protrudes from a surface in a thickness direction of the base plate 2.

The hook-and-loop fastener 1 according to the present invention is used, for example, as a male hook-and-loop fastener. In a more specific example, when two hook-and-loop fasteners engaging with each other are constituted by male and female hook-and-loop fasteners, the male hook-and-loop fastener may be constituted by the hook-and-loop fastener 1 according to the present invention and the female hook-and-loop fastener may be constituted by a hook-and-loop fastener in which plural loops as engaging elements protrude from a woven or knitted base fabric. When two hook-and-loop fasteners engaging with each other are constituted by male hook-and-loop fasteners, both of the two male hook-and-loop fasteners may be constituted by the hook-and-loop fastener 1 according to the present invention, or only one of the two male hook-and-loop fasteners may be constituted by the hook-and-loop fastener 1 according to the present invention and the other hook-and-loop fastener may be constituted by a hook-and-loop fastener manufactured using a manufacturing method other than the manufacturing method according to the present invention.

The base plate 2 is a plate as a base from which the engaging element group 3 protrudes and both surfaces in the thickness direction thereof are planar and are parallel to each other in this embodiment. Here, the shape and the thickness of the base plate 2 are not particularly limited in the present invention.

The engaging element group 3 includes plural engaging elements 31 protruding from plural positions on one surface of the base plate 2. The engaging element group 3 includes plural engaging elements 31 which are regularly arranged. In the drawings, the engaging element group 3 includes plural engaging element lines 31L each having plural engaging elements 31 arranged in a line and the plural engaging element lines 31L are arranged at equal intervals in a direction perpendicular to the extending direction of the lines. More specifically, in each engaging element line 31L, plural engaging elements 31 are arranged in a line at equal intervals. Regarding a relationship between neighboring engaging element lines 31L and 31L, one of plural engaging elements 31 and 31 constituting one engaging element line 31L is disposed between neighboring engaging elements 31 and 31 in the other engaging element line 31L. In other words, the neighboring engaging element lines 31L and 31L have a relationship in which the engaging elements 31 are arranged in a zigzag manner.

Each engaging element 31 includes a pillar body portion 31*a* and an engaging portion 31*b* protruding from the tip of the pillar body portion 31*a*. More specifically, in the drawing, each engaging element 31 includes a pillar body portion 31*a* having a cylindrical shape and an engaging portion 31*b* having a semispherical shape. In the present invention, the shape of the pillar body portion 31*a* is not particularly limited to the cylindrical shape and may be other shapes such as a prism shape, and, for example, the cross-section of the prism shape may be triangular, quadrangular, pentagonal, hexagonal, or other polygonal.

The engaging portion 31*b* has a shape in which a circular surface which is a bottom surface 31*c* of the semispherical shape is continuous from the tip surface of the pillar body portion 31*a*. When viewed in the extending direction of the pillar body portion 31*a*, as illustrated in the enlarged part of a one-dot chained line in FIG. 1A, the outer circumference (the outer circumference of the bottom surface 31*c*) of the engaging portion 31*b* is greater than the outer circumference of the pillar body portion 31*a* over the whole circumference in the circumferential direction, and the outer circumference of the engaging portion 31*b* and the outer circumference of the pillar body portion 31*a* are so-called concentric. Accordingly, the engaging portion 31*b* is thicker than the pillar body portion 31*a*.

Figure 5A:
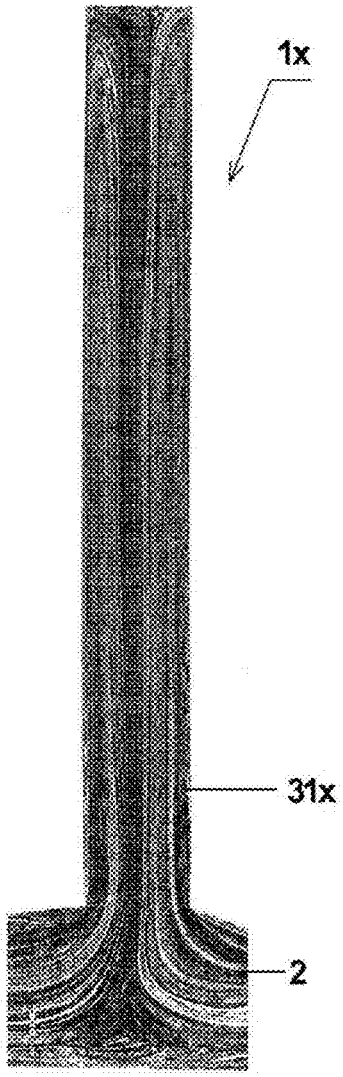
FIGS. 5A and 5B are photographs illustrating states observed with a polarization microscope, where
Figure 5B:
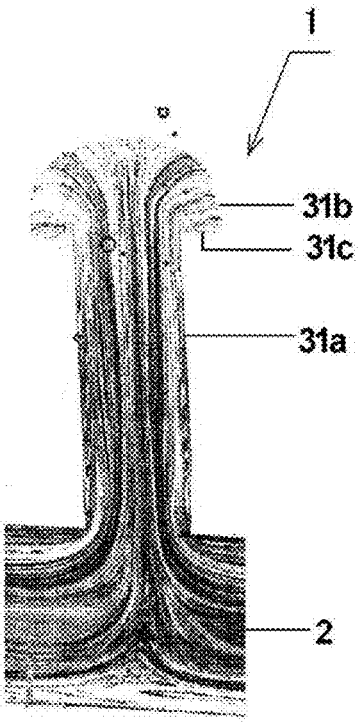

As illustrated in FIGS. 1A and 1B, the bottom surface 31*c* of the engaging portion 31*b* has an annular shape protruding outward from the outer circumference of the pillar body portion 31*a*, and serves as an engaging face engaging with engaging elements of another hook-and-loop fastener. It is preferable that the engaging face 31*c* have a plane in a part thereof. As illustrated in FIG. 5B, since the engaging face 31*c* is a plane extending in a direction substantially perpendicular to the side surface of the pillar body portion 31*a* and the pillar body portion 31*a* extends in a direction substantially perpendicular to one surface in the thickness direction of the base plate 2, one surface in the thickness direction of the base plate 2 and the engaging face 31*c* are substantially parallel to each other. In other words, an intersection angle θ of the engaging face 31*c* and the side surface of the pillar body portion 31*a* is 90° in the illustrated example as illustrated in the enlarged part of a one-dot chained line in FIG. 1B, and is preferably equal to or greater than 90°. The upper limit of the intersection angle θ is less than 180°, preferably less than 150° in view of product performance, and more preferably equal to or less than 135°.

As illustrated in FIGS. 2A to 4C, an example of a method of manufacturing the hook-and-loop fastener 1 according to the present invention includes an injecting molding step of forming a molded product 1$x$ in which a pillar group 3$x$ including pillars constituting the engaging element group 3 and the base plate 2 having a surface from which the pillar group 3$x$ protrudes are integrated into a unified body, a cutting step of forming a cut product 1$y$ in which a small pillar group 3$y$ which is shorter than the pillar group 3$x$ and the base plate 2 are integrated into a unified body by cutting the tip part of the pillar group 3$x$, a melting step of forming the shape of the engaging element group 3 by melting the tip part of the small pillar group 3$y$, and a cooling step of forming the hook-and-loop fastener 1 by cooling.

Figure 2:
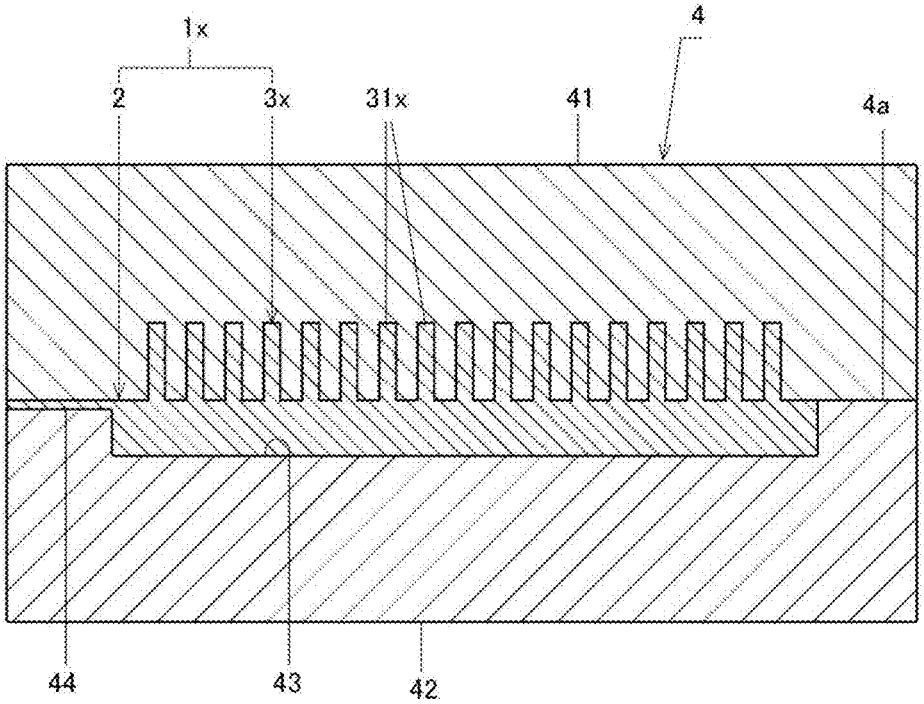
FIG. 2 is a cross-sectional view illustrating an injection molding step.

For example, as illustrated in FIG. 2, the injection molding step uses a mold 4 including a fixed mold 41 and a movable mold 42 which are opened and closed relatively in the vertical direction. In this example, it is assumed that the fixed mold 41 is disposed upside and the movable mold 42 is disposed downside. The mold 4 includes a cavity 43 corresponding to the shape of the molded product 1$x$ and a gate 44 communicating with the cavity 43 as a space part in a contact surface 4$a$ between the fixed mold 41 and the movable mold 42. The cavity 43 is formed by an uneven surface of the mold 4 (more specifically, uneven surface (hereinafter referred to as a "cavity surface") having a shape corresponding to the shape of the molded product). The fixed mold 41 and the movable mold 42 are attached to an injection molding machine (not illustrated) so as to face each other vertically, and the movable mold 42 is disposed to be vertically movable. The injection molding step is performed by injecting molten resin into the cavity 43 of the mold 4. Examples of the molten resin include polypropylene, polyacetal, and nylon, and polypropylene can be preferably used to form the engaging portion 31$b$ in an ideal semispherical shape.

The molded product 1$x$ formed through the injection molding step includes the base plate 2 and the pillar group 3$x$ as described above. The pillar group 3$x$ includes plural pillars 31$x$ which are regularly arranged on one surface of the base plate 2 in the same arrangement as in the engaging element group 3. FIG. 5A is a photograph illustrating a state of a cut surface which has been observed with a polarization microscope when the molded product 1$x$ is cut along a plane parallel to the length direction of the pillar 31$x$. This photograph illustrates the internal structures of the base plate 2 and the pillar 31$x$, and a laminated structure of resin layers extending from the inside of the base plate 2 in the protruding direction of the pillar 31$x$ (toward the tip of the pillar 31$x$) can be confirmed therefrom. Plural resin layers are superposed on each other, and more specifically, plural layers are superposed in the thickness direction in an area of the base plate 2 other than an area continuous to the base of the pillar 31$x$ and are superposed in the radial direction of the pillar 31$x$ in an area (an intermediate area and an area close to the base) below the tip portion of the pillar 31$x$. In the base plate 2, the resin layers are curved to be uplifted to the pillar 31$x$ in the vicinity of the base of the pillar 31$x$.

The resin layers can be considered to indicate a flow of molten resin injected in the injection molding step. The molded product 1$x$ illustrated in FIG. 5A is formed of a black resin so as to easily observe the flow of molten resin, and the flow of molten resin (resin layers) can be grasped by plural white lines and black lines in FIGS. 5A and 5B. One white line and one black line correspond to one resin layer. From the shapes of the layers, it can be considered that molten resin flows in the cavity from the space part corresponding to the base plate 2 to the space part corresponding to the pillar 31$x$, straightly rises from the space part corresponding to the base of the pillar 31$x$ to the space part corresponding to the tip portion of the pillar 31$x$, collides with the cavity surface forming the tip portion of the pillar 31$x$, is smoothly bent after the collision, falls, and finally fills the cavity. In other words, the layers in the intermediate area of the pillar 31$x$ have shapes parallel to the length direction of the pillar 31$x$ (shapes extending in the length direction). From this shape, it can be seen that the molten resin is in a laminar flow when the molten resin is cooled and solidified in the intermediate area of the pillar 31$x$. On the other hand, the layers in the tip portion of the pillar 31$x$ have shapes which are bent to the base (to the base plate 2) of the pillar 31$x$ with the vicinity of the tip of the pillar 31$x$ as a turning point. From this shape, it can be seen that the molten resin is in a turbulent flow when the molten resin is cooled and solidified in the tip portion of the pillar 31$x$.

Figure 3A:
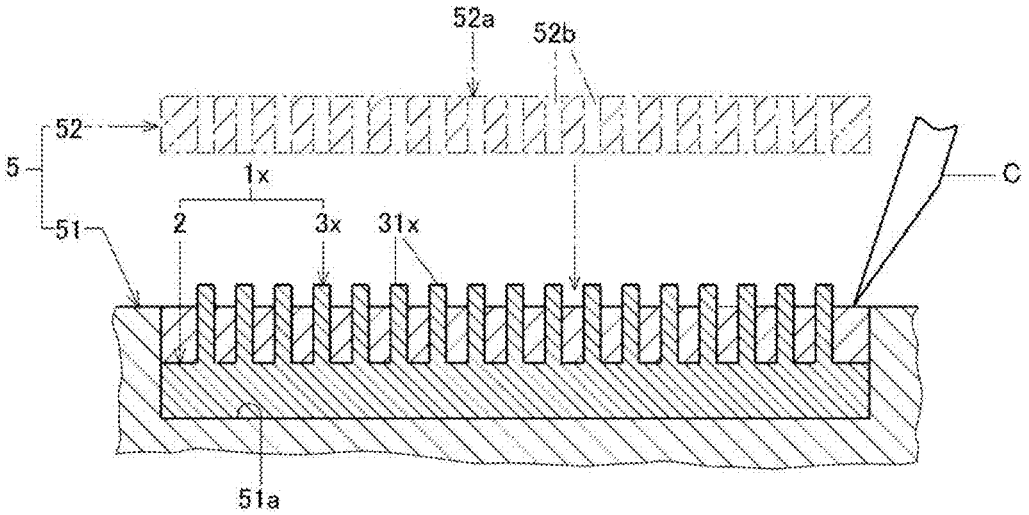
FIGS. 3A, 3B, and 3C are cross-sectional views illustrating a detailed flow of a cutting step.
Figure 3B:
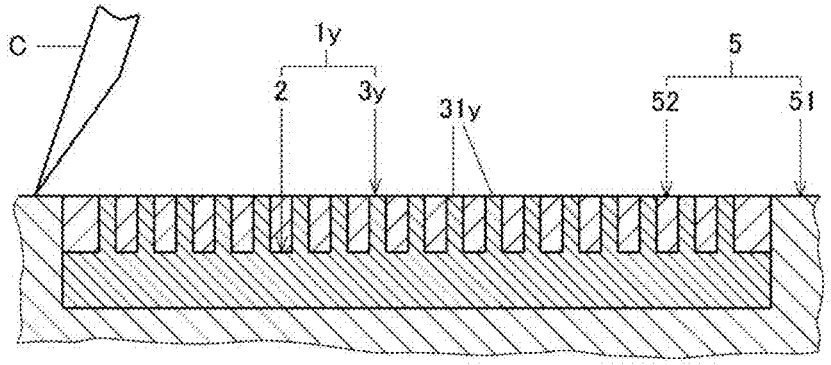
Figure 3C:
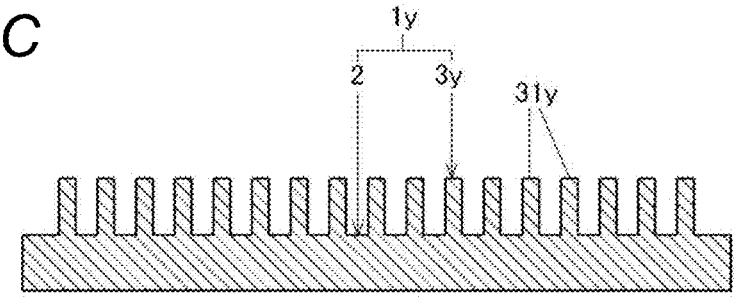

The cutting step uses a jig 5, for example, as illustrated in FIGS. 3A to 3C. The jig 5 includes a lower jig 51 in which a reception opening 51$a$ for receiving the molded product 1$x$ is formed and an upper jig 52 in which a hole group 52$a$ into which the pillar group 3$x$ is inserted is formed. Most of the molded product 1$x$ is received in a space formed between the lower jig 51 and the upper jig 52, and the tip part of the pillar group 3$x$ protrudes upward from the upper jig 52.

The reception opening 51$a$ having a size slightly larger than the size of the base plate 2 is formed on the top surface of the lower jig 51. The depth of the reception opening 51$a$ is set to be greater than the thickness of the base plate 2 and is set to be less than the total height of the molded product 1$x$ (the sum of the thickness of the base plate 2 and the total height of the pillar 31$x$).

The upper jig 52 is a flat plate having substantially the same size as the size of the base plate 2, and the thickness thereof is set to be less than the total height of the pillar 31$x$ such that the hole group 52$a$ including plural holes 52$b$ into which the pillars 31$x$ of the pillar group 3$x$ are inserted penetrate the upper jig 52 in the thickness direction thereof.

As illustrated in FIG. 3A, when the molded product 1$x$ is received in the jig 5, the tip portions of the pillars 31$x$ of the pillar group 3$x$ protrude upward from the upper jig 52. The protruding tip portions of the pillars 31$x$ are portions (portions which are formed by the molten resin having risen, then having been smoothly bent, and having fallen) in which the resin layers are bent in a U shape as illustrated in the photograph of FIG. 5A.

Figure 4A:
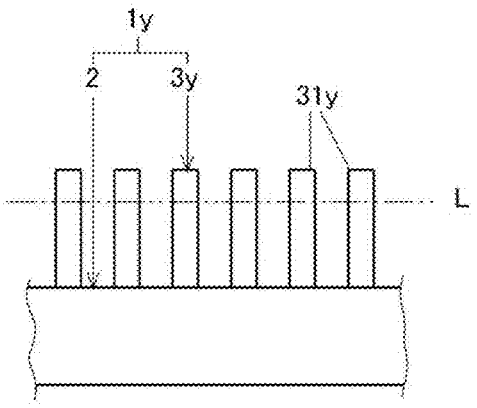
FIGS. 4A, 4B, and 4C are diagrams illustrating a cutting step, a melting step, and a cooling step.

As illustrated in FIG. 3B, the tip portions of the pillars 31$x$ are cut by causing an edge of a cutter C to slide on the top surface of the upper jig 52. Accordingly, as illustrated in FIG. 4A, the tip portions of the pillars 31$x$ are cut along a virtual cutting line L parallel to the surface of the base plate 2 from which the pillar group 3$x$ protrudes, thereby forming a cut product 1$y$. Thereafter, as illustrated in FIG. 3C, the cut product 1$y$ is taken out of the jig 5. The cut product 1$y$ includes a small pillar group 3$y$ which is shorter than the pillar group 3$x$ in the total height (protruding length) and the base plate 2 having a surface from which the small pillar group 3$y$ protrudes. In the tip portions of the plural small pillars 31$y$ constituting the small pillar group 3$y$, the resin layers are arranged to be substantially parallel to each other along the length direction of the pillars 31$x$.

Figure 4B:
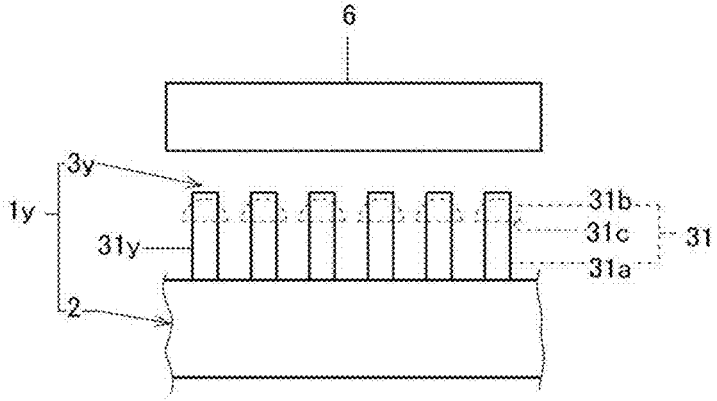
Figure 4C:
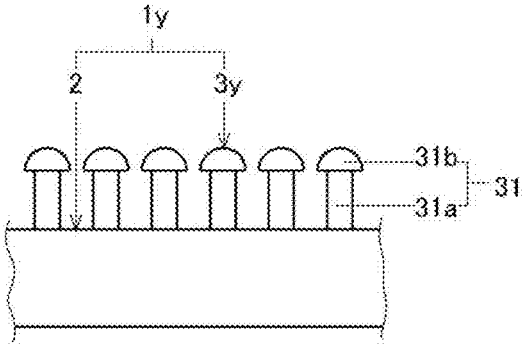

The melting step uses a heater 6 as illustrated in FIG. 4B. The heater 6 is disposed to be separated from the tip of the small pillar group 3$y$ of the cut product 1$y$ in the protruding direction (upward direction) of the small pillars 31$y$. That is, the heater 6 is disposed in a non-contact state with the tip part of the small pillar group 3$y$. Since the heater 6 has a flat panel shape and is disposed in parallel to the base plate 2 to face each other, the heater 6 is separated to be equidistant from the tips of the small pillars 31*y* of the small pillar group 3*y* and is configured to uniformly heat the small pillars 31*y*. By heating the tip portions of the small pillars 31*y* using the heater 6 of a high temperature for a predetermined time, the tip portions of the small pillars 31*y* are melted. Accordingly, a pillar body portion 31*a* which is a non-melted portion and an engaging portion 31*b* which is a melted portion are formed from each small pillar 31*y*. In order to melt only the tip portions of the small pillars 31*y* and not to add heat of the heater 6 to the other portions, for example, the cut product 1*y* is immersed in water, and only the tip portions of the small pillars 31*y* of the small pillar group 3*y* protrude from water and then are heated. Accordingly, the tip portions of the small pillars 31*y* are melted, and the melted resin is cooled in the water surface and does not easily move downward from the water surface. As a result, the bottom surface 31*c* of the engaging portion 31*b* is likely to be parallel to the top surface of the base plate 2 and the engaging portion 31*b* is likely to have a semispherical shape having less distortion.

In the cooling step, by cooling the engaging portions 31*b* which are at a high temperature immediately after the melting step, the engaging portions 31*b* are solidified and the shape of the engaging elements 31 each including the pillar body portion 31*a* and the engaging portion 31*b* is determined, thereby forming a mushroom hook-and-loop fastener 1. In the cooling step, the engaging portions 31*b* may be forcibly cooled by wind from a fan or the engaging portions 31*b* may be cooled naturally by leaving the engaging portions for a predetermined time.

In the above-mentioned example of the manufacturing method according to the present invention, a material other than the resin as the molding material does not have to be used essentially. The tip parts of the pillar group 3*x* hardly include impurities other than the molding material and thus can be collected and reused, and undesired substance which is generated in the manufacturing course can be easily disposed of. Since the heater 6 is disposed in a non-contact state with the small pillar group 3*y*, it is possible to reduce a cause of defective products.

Figure 6:
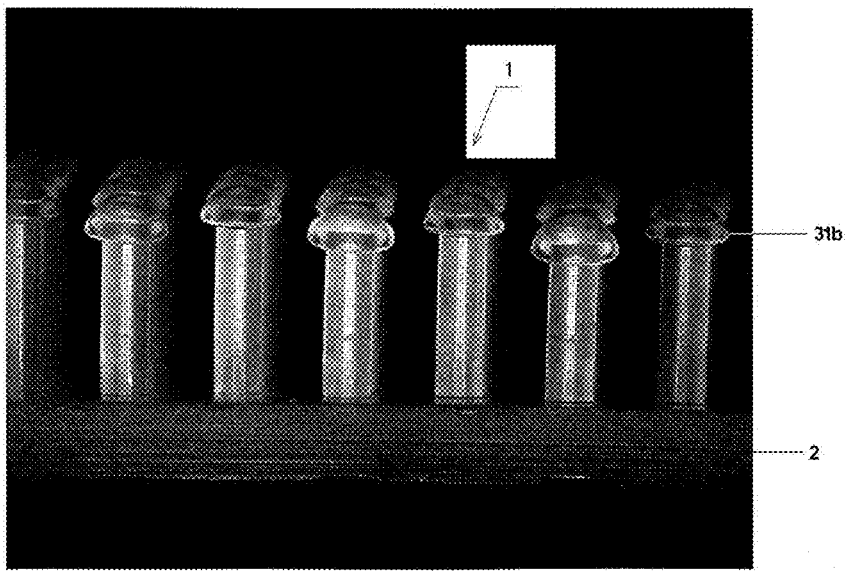
FIG. 6 is a photograph illustrating a hook-and-loop fastener according to a comparative example.

In the above-mentioned example of the manufacturing method according to the present invention, the engaging elements 31 constituting the engaging element group 3 have an engaging portion 31*b* having a less-distorted semispherical shape. FIG. 6 is a photograph illustrating a state when the mushroom hook-and-loop fastener 1 manufactured by the example of the manufacturing method according to the present invention is observed with an optical microscope, where the engaging portion 31*b* of each engaging element 31 has a semispherical shape and the bottom surface 31*c* thereof is almost parallel to one surface of the base plate 2. FIG. 5B is a photograph illustrating a state when a cut surface, which is obtained by cutting the mushroom hook-and-loop fastener 1 manufactured by the example of the manufacturing method according to the present invention along a plane parallel to the length direction of the pillar body portion 31*a*, is observed with an optical microscope, from which the internal structures (resin layers) of the base plate 2 and the pillar 31*x* can be seen. From these drawings, it can be seen that the layers extend radially from the tip of the pillar body portion 31*a* and the plural layers are laminated in the circumferential direction in the cross-sectional photographs. More specifically, in the vicinity of the bottom surface 31*c* (engaging face) of the engaging portion 31*b*, the layers extend along the bottom surface 31*c*.

Figure 7:
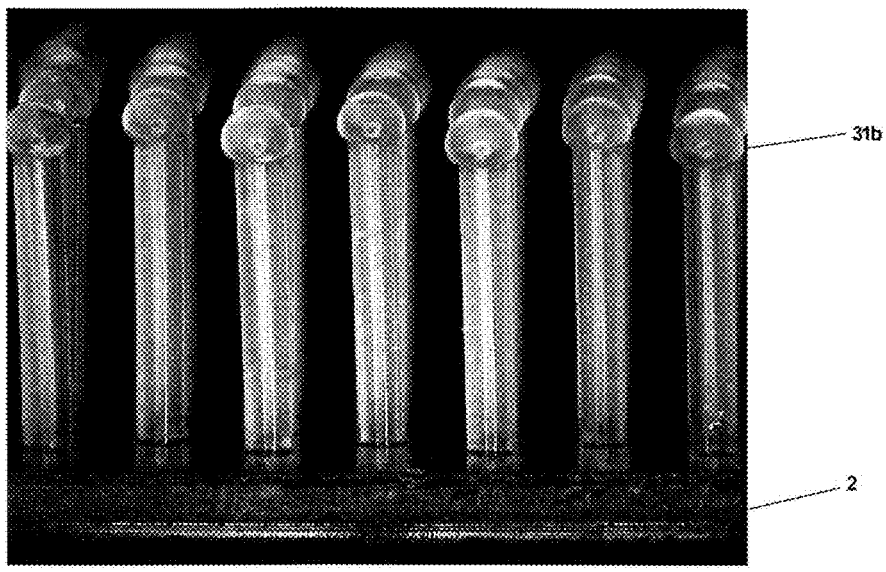
FIG. 7 is a photograph illustrating a hook-and-loop fastener which is manufactured according to an example of a manufacturing method according to the present invention.

FIG. 7 is a photograph illustrating a state when a mushroom hook-and-loop fastener according to a comparative example is observed with an optical microscope. The hook-and-loop fastener according to the comparative example is not subjected to the cutting step of the present invention, and the tip portions of the pillars 31*x* are melted in the state illustrated in FIG. 5A. That is, the hook-and-loop fastener according to the comparative example is manufactured through the injection molding step, the melting step, and the cooling step. In this case, the turbulent flow of the molten resin in the melted tip portion of each pillar 31*x* affects the shape of the engaging portion 31*b* after the melting step and the engaging portion 31*b* has a distorted shape like a crushed sphere. Particularly, the bottom of the engaging portion 31*b* has a shape which is uplifted in a spherical shape to the base plate 2 side. Accordingly, the engaging portion 31*b* having this shape cannot exhibit an engaging force (coupling force) as a mushroom hook-and-loop fastener.

As can be seen from the comparative example, in order to acquire an engaging portion 31*b* having an ideal semispherical shape as in the example of the hook-and-loop fastener according to the present invention, it is important that the resin layers are substantially parallel to each other along the length direction of the pillar 31*x* in the tip portion of the melted small pillar 31*y*. Since the outer layer of the resin layers forms the bottom surface 31*c* of the engaging portion 31*b* and the vicinity thereof, at least the outer layer preferably has a shape which is substantially parallel to the length direction of the pillar 31*x* over the whole outer circumference of the pillar 31*x*, and the inner layers of the resin layers are not particularly limited.

Figure 8A:
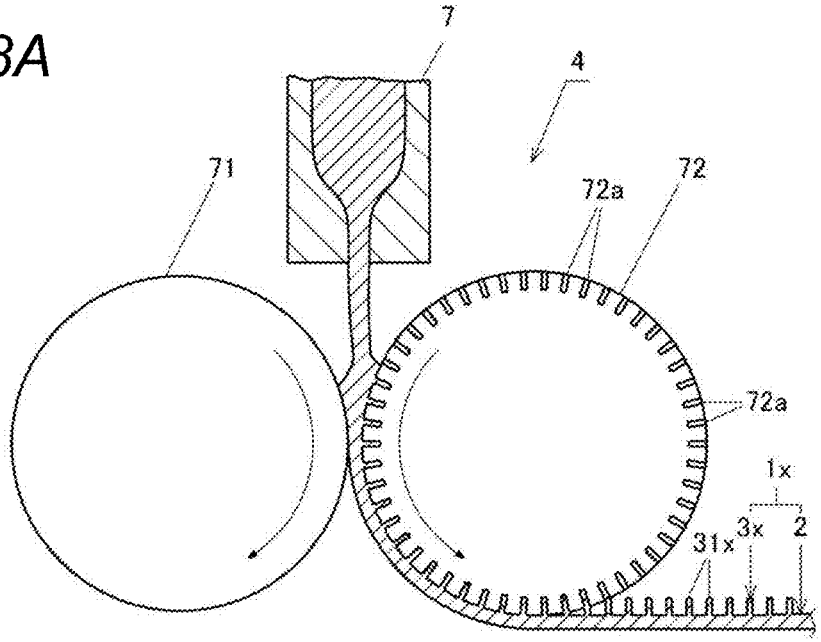
FIGS. 8A and 8B are diagrams illustrating other examples of the injection molding step.
Figure 8B:
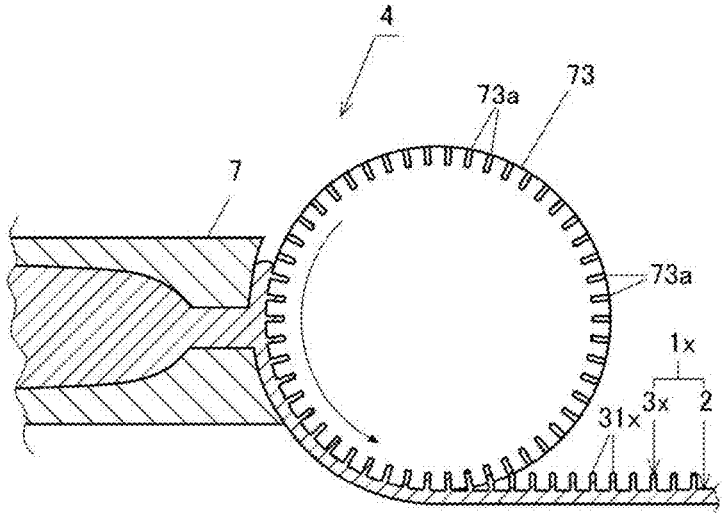

Another example of the method of manufacturing the hook-and-loop fastener 1 according to the present invention is different from the above-mentioned example in only the injection molding step as illustrated in FIGS. 8A and 8B.

In the example illustrated in FIG. 8A, a mold 4 is disposed below a nozzle 7 of an injection molding machine with a gap therebetween. The mold 4 includes a first drum 71 and a second drum 72. The first drum 71 and the second drum 72 are disposed to face each other with a gap corresponding to the thickness of the base plate 2 interposed therebetween. In the first drum 71, the surface of the cylindrical surface thereof is a smooth surface having no unevenness. On the other hand, in the second drum 72, cavities 72*a* for forming the pillars 31*x* of the pillar group 3*x* are formed on the surface of the cylindrical surface over the whole circumference in the circumferential direction. A cavity surface forming each cavity 72*a* is a concave surface in which a portion corresponding to the tip of the pillar 31*x* is closed. The first and second drums 71 and 72 are disposed to be rotatable about the centers of the cylindrical surfaces thereof, respectively.

In the example illustrated in FIG. 8A, when the first and second drums 71 and 72 are slowly rotated while injecting molten resin between the first drum 71 and the second drum 72 from the nozzle 7, the molten resin filled between the first drum 71 and the second drum 72 forms the base plate 2 and flows into the cavities 72*a* of the second drum 72 to form the pillars 31*x*, and a continuous molded product 1*x* is sent out with the rotation of the second drum 72.

In the example illustrated in FIG. 8B, a mold 4 is constituted by a nozzle 7 of an injection molding machine and a third drum 73 which is disposed with a gap with respect to molten resin injected from the nozzle 7.

The third drum 73 is disposed to be rotatable about the center of the cylindrical surface thereof. The third drum 73 has cavities 73*a* formed to form the pillars 31*x* similarly to the second drum 72.

The tip surface of the nozzle 7 is formed as a curved surface which is concave in an arc-like sectional shape. The curved surface is a surface having an arc-like sectional shape of which the diameter is larger than that of the third drum 73. The nozzle 7 is disposed with a gap from the cylindrical surface of the third drum 73 such that the center of the arc of the curved surface matches the center of the third drum 73.

In the example illustrated in FIG. 8B, when the third drum 73 is slowly rotated while injecting molten resin to the third drum 73 from the nozzle 7, the molten resin filled between the nozzle 7 and the third drum 73 forms the base plate 2 and flows into the cavities 73*a* of the third drum 73 to form the pillars 31*x*, and a continuous molded product 1*x* is sent out with the rotation of the third drum 73.

In the internal structure of the molded product 1*x* obtained through the injection molding step illustrated in FIGS. 8A and 8B, the resin layers are formed in parallel to the length direction of each pillar 31*x* in the intermediate portion of the pillar 31*x*. Accordingly, the molded product 1*x* becomes a mushroom hook-and-loop fastener through the cutting step, the melting step, and the cooling step, as described in the above-mentioned example. Each engaging element of the hook-and-loop fastener has an engaging portion having a semispherical shape.

The present invention is not limited to the above-mentioned embodiment, but can be appropriately modified without departing from the gist thereof. For example, in the engaging element group 3 of the above-mentioned embodiment, the engaging elements 31 constituting the neighboring engaging element lines 31L are arranged in a zigzag manner, but the present invention is not limited to this configuration. In the present invention, the engaging elements 31 may be arranged at equal intervals vertically and horizontally.

In each engaging element of the above-mentioned embodiment, the engaging face protrudes from the outer circumference of the pillar body portion over the whole circumference in the circumferential direction, but the present invention is not limited to the engaging face formed over the whole circumference. For example, the engaging face may protrude from only a part of the whole outer circumference of the pillar body portion. More specifically, as illustrated in FIGS. 1, 2, and 3 of U.S. Pat. No. 6,678,924, the engaging element may have an engaging face in only a part of the circumference of the pillar body portion having a cross-like sectional shape, not the whole circumference, by forming a pillar to have a cross-like sectional shape, cutting an intermediate portion of the pillar, and then thermally melting the cut cross-section.

What is claimed is:

1. A hook-and-loop fastener manufacturing method comprising:

an injection molding step of performing injection molding to form a molded production which a pillar group which is a set of a plurality of pillars and a base plate having a surface from which the pillar group protrudes are integrated into a unified body;

a step of providing the base plate in a lower jig and the pillars of the pillar group in a plurality of holes in an upper jig, wherein a tip part of the pillar group protrudes from the upper jig;

a cutting step of cutting the tip part of the pillar group to form a cut product with a small pillar group which is shorter than the pillar group;

a removal step of removing the cut product from the upper jig and the lower jig;

a melting step of melting the tip part of the small pillar group by arranging a heater with respect to the tip part of the small pillar group in a non-contact state to form pillar body portions which are non-melted portions and engaging portions which are melted portions and which have semispherical shapes so as to be thicker than the pillar body portions from small pillars constituting the small pillar group; and a cooling step of cooling the engaging portions to determine shapes of a plurality of engaging elements including the pillar body portions and the engaging portions having the semispherical shapes, thereby forming a mushroom hook-and-loop fastener in which an engaging element group which is a set of the plurality of engaging elements and the base plate are integrated into a unified body.

2. The hook-and-loop fastener manufacturing method according to claim 1, wherein each of the engaging portions includes an engaging face protruding outward from a tip of the respective pillar body portions over a whole circumference in a circumferential direction thereof.

3. The hook-and-loop fastener manufacturing method according to claim 2, wherein an intersection angle between the engaging face and a side surface of the respective pillar body portions is equal to or greater than 90° and less than 150°.

* * * * *